US008752493B2

(12) United States Patent
Øxseth et al.

(10) Patent No.: US 8,752,493 B2
(45) Date of Patent: Jun. 17, 2014

(54) SEVENTH BRIDLE BLOCK SYSTEM FOR A PARAVANE

(75) Inventors: Erlend Øxseth, Lier (NO); Michal Gumos, Kongsberg (NO)

(73) Assignee: Ulmatec Baro AS, Fosnavag (NO)

( * ) Notice: Subject to any disclaimer, the term of this patent is extended or adjusted under 35 U.S.C. 154(b) by 275 days.

(21) Appl. No.: 13/302,864

(22) Filed: Nov. 22, 2011

(65) Prior Publication Data

US 2012/0125249 A1 May 24, 2012

Related U.S. Application Data

(60) Provisional application No. 61/416,091, filed on Nov. 22, 2010.

(51) Int. Cl.
*B63B 21/66* (2006.01)

(52) U.S. Cl.
USPC ..... 114/253

(58) Field of Classification Search
USPC ..... 114/253, 254, 244, 245; 367/15, 16
See application file for complete search history.

(56) References Cited

U.S. PATENT DOCUMENTS

| | | | | |
|---|---|---|---|---|
| 4,574,723 | A | 3/1986 | Chiles et al. | |
| 6,681,710 | B2 | 1/2004 | Semb | |
| 7,404,370 | B2 * | 7/2008 | Stokkeland | 114/253 |
| 7,577,060 | B2 * | 8/2009 | Toennessen et al. | 367/16 |
| 7,658,161 | B2 | 2/2010 | Toennessen et al. | |
| 2009/0050044 | A1 | 2/2009 | Stokkeland et al. | |

FOREIGN PATENT DOCUMENTS

| | | | |
|---|---|---|---|
| EP | 168959 | A1 | 1/1986 |
| GB | 2122562 | A | 1/1984 |
| GB | 2266285 | A | 10/1993 |
| WO | WO 81/03475 | A1 | 12/1981 |

* cited by examiner

*Primary Examiner* — Lars A Olson
*Assistant Examiner* — Anthony Wiest
(74) *Attorney, Agent, or Firm* — Birch, Stewart, Kolasch & Birch, LLP

(57) ABSTRACT

A bridle block system for a paravane for seismic equipment includes a main bridle block with a connecting point for a towing line from a seismic vessel, and with attachment points for first and second triples of bridle lines to first and second lugs at either ends of the paravane. The main block includes a pivot point for a pivot arm, which has an arm with an attachment point near its end for the first triple bridle lines, and an oppositely directed arm with an attachment point near its outer end for second triple bridle lines. An auxiliary moment arias at the second arm's side is connected to a seventh bridle line, further connected to an actuator arranged near the first bridle lines' forward lugs' of the paravane. The seventh bridle exerts a force imbalance between the fore and aft bridle lines to change the paravane's angle of attack.

20 Claims, 6 Drawing Sheets

SEVENTH BRIDLE BLOCK SYSTEM FOR A PARAVANE

CROSS REFERENCE TO RELATED APPLICATIONS

Figure 1:
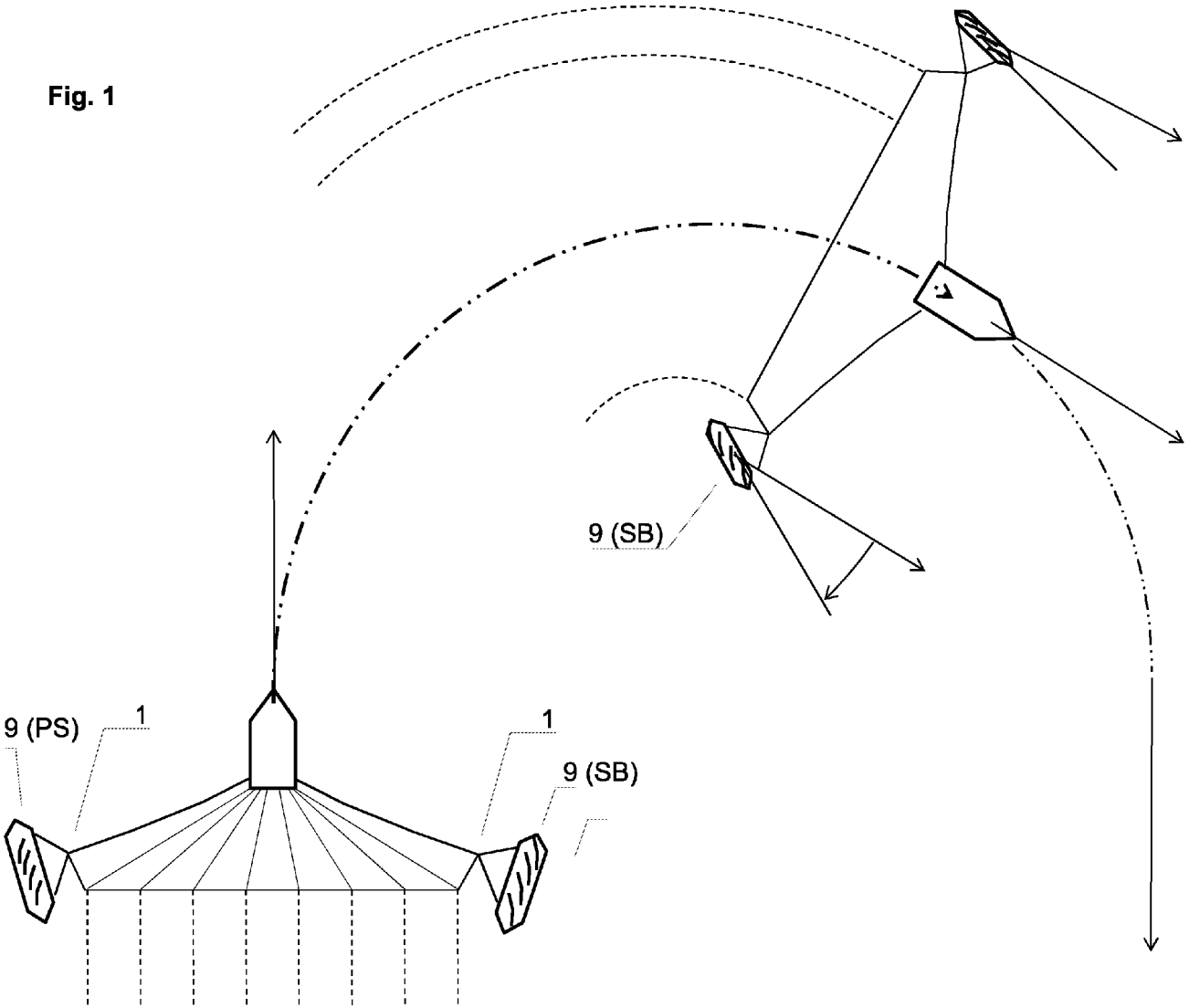

This nonprovisional application claims the benefit of U.S. Provisional Application No. 61/416,091 filed on Nov. 22, 2010. The entire contents of the above application is hereby incorporated by reference.

INTRODUCTION

The present invention relates to a bridle block system for a paravane. More specifically it relates to a device with an extra bridle line for controlling the paravane's angle of attack.

BACKGROUND ART

Marine seismic surveys are usually conducted using a seismic vessel towing seismic sources and a number of parallel streamer cables with hydrophones. The seismic streamer cables may be of several thousand meters length. The parallel streamer cables are usually towed along straight lines over the prospective geological formation. The streamer cables are spanned out by starboard side (SS) and port side (PS) deflectors which in turn are towed by the ship. In order to achieve coverage of the desired geographical area the parallel seismic cables should be towed several times along parallel, oppositely directed course lines. It is rational to turn at the end of each course line and conduct the next course line on an opposite course. An uncontrolled turn at the end of a course line with an unadjusted deflector will, for the outer deflector in the U-turn process, incur an increased load on the towing line, the bridle block, the bridle lines and the deflector's connection points, and on the deflector itself. The inner deflector in the U-turn process should have a certain speed in order to pull to a desired degree, and a deflector with a fixed position may exert an insufficient pulling force.

A commonly used procedure is to pre-set the deflectors' angle of attack manually by manually adjusting the bridle line lengths or to adjust their connectors positions on the bridle block inwardly or outwardly, before the launching of the deflectors. However, such a manually adapted bridle line length does not allow controlling the deflector's heading before, during and after the U-turn: the deflector is fixedly adjusted.

PRIOR ART IN THE TECHNICAL FIELD

US2009/0050044 A1 presents a bridle block for a seismic deflector. The three fore and the three aft bridle lines run each into its corresponding end of a sprocket chain laid over a motorised sprocket sheave which is arranged to displace the towing line's point of attack on the sprocket chain. Thus the seismic deflector's angle of attack may be adjusted inwardly or outwardly. A disadvantage by that US-applications invention is that it does not necessarily return to any default position if the motor of the sprocket sheave should fail. It also has a disadvantage in that it requires power supply from the vessel via the towing line or from the deflector via one of the bridle lines. Power supply via electrical cables which are towed generally athwart relative to the course line may be vulnerable and also increases the diameter of the towing line or one of the bridle lines.

U.S. Pat. No. 7,658,161 Tønnesen: "System for depth control of a marine deflector", shows in FIG. 8B a deflector having fore and aft triples of bridle lines to upper, middle and lower horizontal plate frames. In the description is noted that all lines may be adjusted inwardly and outwardly so as for the tilt angle relative to the vertical line may be controlled in order to control both the depth and the angle of attack relative to the course line in the horizontal plane. Tønnesen outlines several different possible actuators which are of little detail with regard to mechanical design.

U.S. Pat. No. 4,574,723 describes a deflector with a mechanism wherein the two lower of the bridle lines may be slackended in order to make the deflector lie horisontally in the sea so as for facilitating the hauling. It may also vary the tilt angle relative to the vertical line in a rather extreme way.

EP0168959 describes an airgun deflector, a so-called paravane, having a longitudinally directed cogged rail which joins the paravane-ends of the bridle lines in order to adjust the fore and aft bridle lines simultaneously. It is not feasible for retrofitting because the paravane's connection points are not directly adapted for the retrofitting, but wherein a retrofitting also of a number of sheaves and attachments on the paravane is required.

GB2266285 British Aerospace ltd. displays a bomb towed behind a military airplane, wherein the bomb may be guided by means of three bridle lines which may be adjusted using bridle line control winches.

UK patent application GB2122562A describes an improved pelagic trawl door or paravane. The paravane has a hydrofoil profile and towing devices comprising a triple bridle arranged for attaching to a towing line. A stepwise control rail (ref. no. 8) is arranged to displace one of the bridle branches forward or aft on the hydrofoil in order to manually adjust the angle of attack. There is also shown a threaded block on a motorized lead screw for displacing the control rail forward or aft for remote control adjustment of the angle of attack.

BRIEF SUMMARY OF THE INVENTION

The present invention is a bridle block system for a paravane (9) for seismic equipment, comprising the following features:

- a main bridle block (1) with a first connecting point (2) for a towing line from a seismic vessel, and with attachment points (7*b*, 5*b*) for first and second triples of bridle lines (8, 11) extending to first lugs (41, 42, 43) and second lugs (51, 52, 53) near opposite ends of the paravane (9). The main block (1) comprises a pivot point (3) for a pivot arm (7, 5). The pivot arm (7, 5) comprises a first arm (7) with an attachment point (7*b*) near its outer end for the first triple of bridle lines (8), and a second, oppositely directed arm (5) with an attachment point (5*b*) near its outer end for the second triple of bridle lines (11). An auxiliary moment arm (12) connected at said second arm's (5) side relative to the pivot point (3) is connected to a so-called seventh bridle line (13), which is further connected to an actuator (14) arranged near the first bridle lines' (8) first lugs' (41, 42, 43) end of the paravane (9). When the actuator is run in either direction, the seventh bridle (13) exerts a force imbalance between the fore and aft bridle lines (8, 11) so as for changing the paravane's angle of attack.

Further embodiments of the invention is specified in the attached dependent claims.

ADVANTAGES OF THE INVENTION

It is easier to steer a seismic vessel along its desired course and then control the heading of the deflectors by means of what we have called a "seventh bridle". Using the invention it is easier to steer a towed seismic array than what is shown in e.g. U.S. Pat. No. 6,681,710B2 FIG. 2, which during varying headings of the seismic vessel, feeds out on starboard side deflector line winches and hauls in on port side deflector line winches on the seismic vessel. By means of the invention we may rather increase or reduce the towing lines' angle of attack when the seismic vessel temporarily has to adjust its heading along the desired course of the towed seismic array, without having to change the lengths of the deflector towing lines.

It is essential to notice that the 7th bridle according to the invention does not change more than a few centimeters or decimeters on the fore and aft bridle lines' operating lengths and thus controls the deflector's angle of attack which further results in a changed angle of attack of the towing line, which then adjusts for small deviations of the vessel's heading so as for the towed seismic array to adjust its course to be the desired correct course line. This is opposed to the U.S. Pat. No. 6,681,710 which adjusts the length of the towing line as such.

Mechanical Robustness

The system according to the present invention is simple and robust compared to the more exposed electrical wire lines with an electrical motor in the bridle block of the prior art. Further it has the advantage in that it does not require energy supply from the vessel via the towing line or from the deflector via one of the bridle lines, but that the actuator, which may be a linear hydraulic actuator or an electrical actuator, is mounted at the paravane and receives energy locally produced in the paravane. Thus one avoids energy supply via vulnerable electrical cables towed athwart of the course line, as such cables are subject to high mechanical tension, waves, water currents, and flotsam, and which would have incurred an increased diameter of the towing line or one of the bridle lines.

BRIEF FIGURE CAPTIONS

The invention is illustrated in the attached drawings, wherein

FIG. 1 is a simplified map view of a seismic acquisition vessel at sea, wherein the seismic vessel tows a seismic array with streamer cables spanned out by deflectors at the starboard and port sides. In the upper right part of the drawing the seismic vessel is about to conduct a U-turn with its seismic towed array. The seismic deflectors are turned more towards starboard than the vessel's turning heading in order for the inner deflector shall turn more sharply than the vessel, and that the outer deflector is turned more towards starboard than its turning course in order for the outer deflector not to be subject to a too high line tension.

Figure 2:
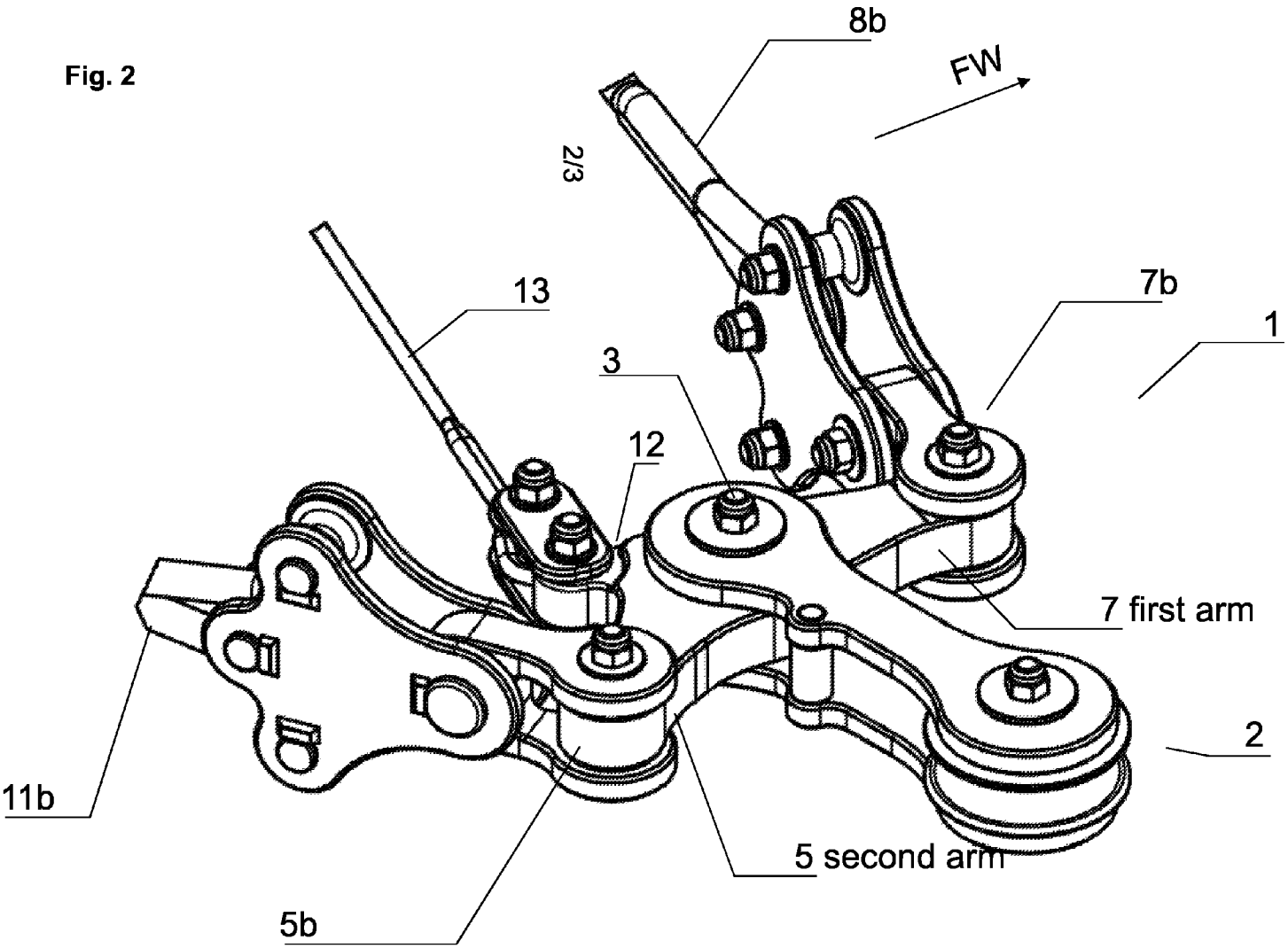

FIG. 2 shows a plane view of a bridle block system for a paravane (9) according to the invention with the "seventh bridle" (13) in an embodiment of a wire, line or stay and which is connected to an actuator (14), please see FIG. 3, which drives the 7th bridle. The bridle block system comprises a main block (1) with a first attachment point (2) for a towing line from the towing seismic vessel and a generally vertically arranged pivot axis (3) for a pivot arm (7, 5). The pivot arm comprises a forward directed arm (7) with an attachment point (7*b*) near its outer end for the forward triple of bridle lines (8*a*, 8*b*, 8*c*), and a generally oppositely directed arm (5) with an attachment point (5*b*) near the arm's (5) outer end for the aft bridle lines (11*a*, 11*b*, 11*c*). A moment arm (12) is connected to the rearward directed arm's (5) side of the pivot point (3), arranged for exerting a moment on the pivot arm (5, 7).

Figure 3A:
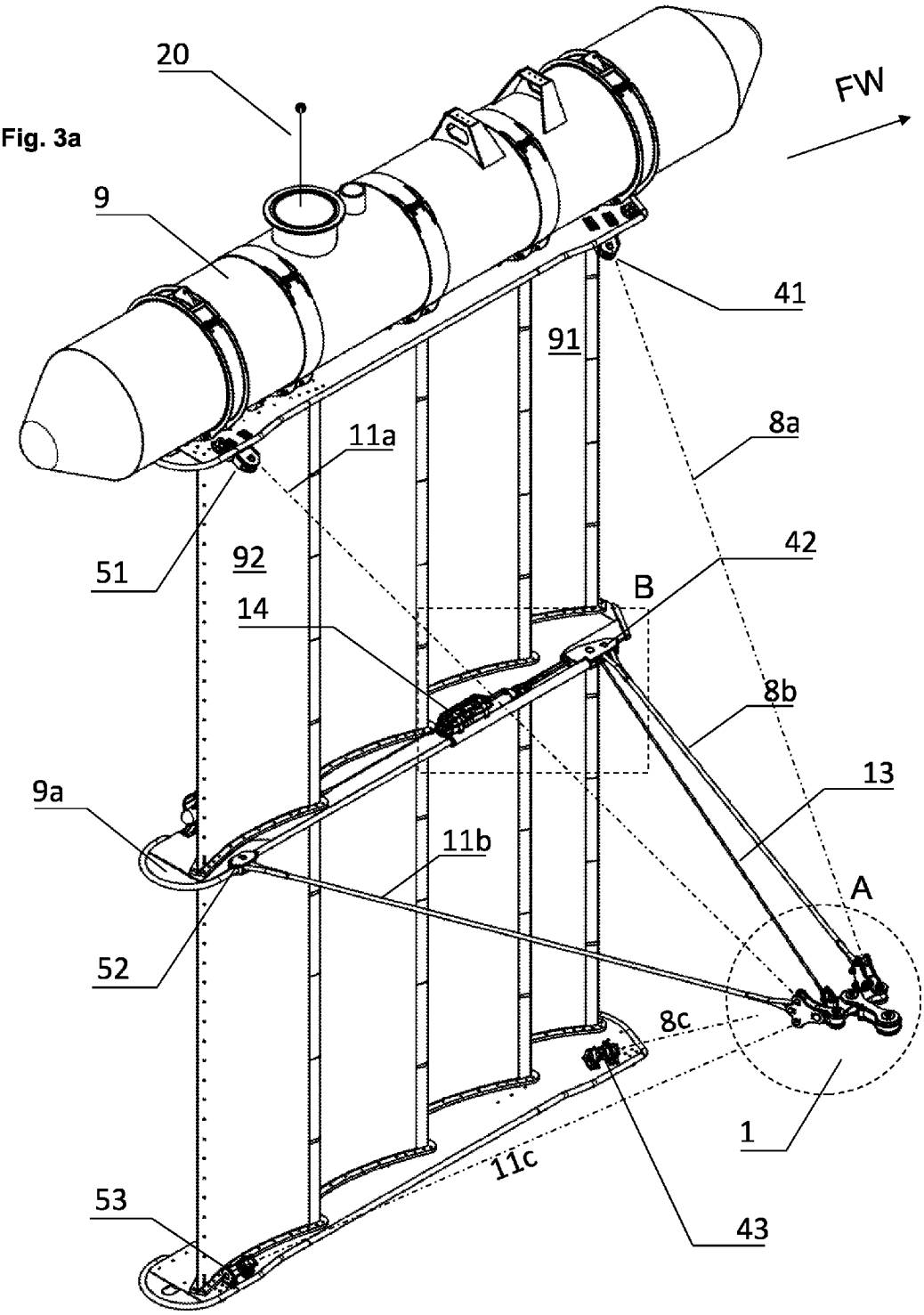

FIG. 3*a* is a perspective view of an embodiment of the invention with a paravane (9), an actuator (14) arranged on a center plate (9*a*) that drives the so-called "seventh bridle" (13) forming a force imbalance between the fore and aft bridle lines (8, 11) so as for changing the paravane's angle of attack.

Figure 3B:
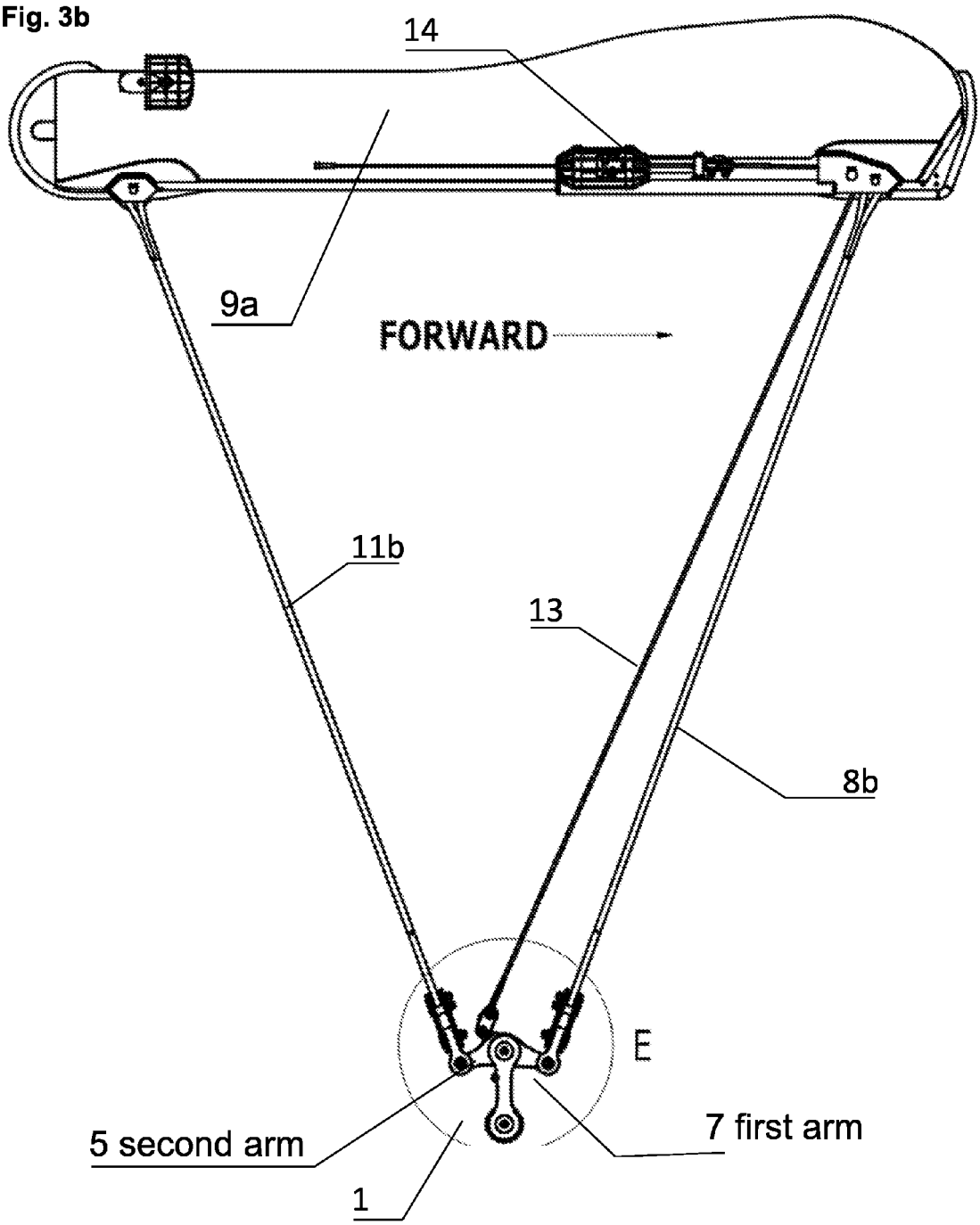

FIG. 3*b* is a plane view through the center plate (9*a*) and the middle fore and aft bridle lines (8*b*, 11*b*), and the bridle block (1). Here it is shown more clearly the diagonal-like arrangement of the seventh bridle (13). Without tension on the seventh bridle (13), the paravane (9) will run with a predetermined angle of attack determined by the geometry of the paravane, bridle block and bridle lines lengths. If the actuator (14) tightens or slackens the seventh bridle line (13) the balance between the fore and aft bridles (8, 11) is affected and the angle of attack will change.

Figure 4:
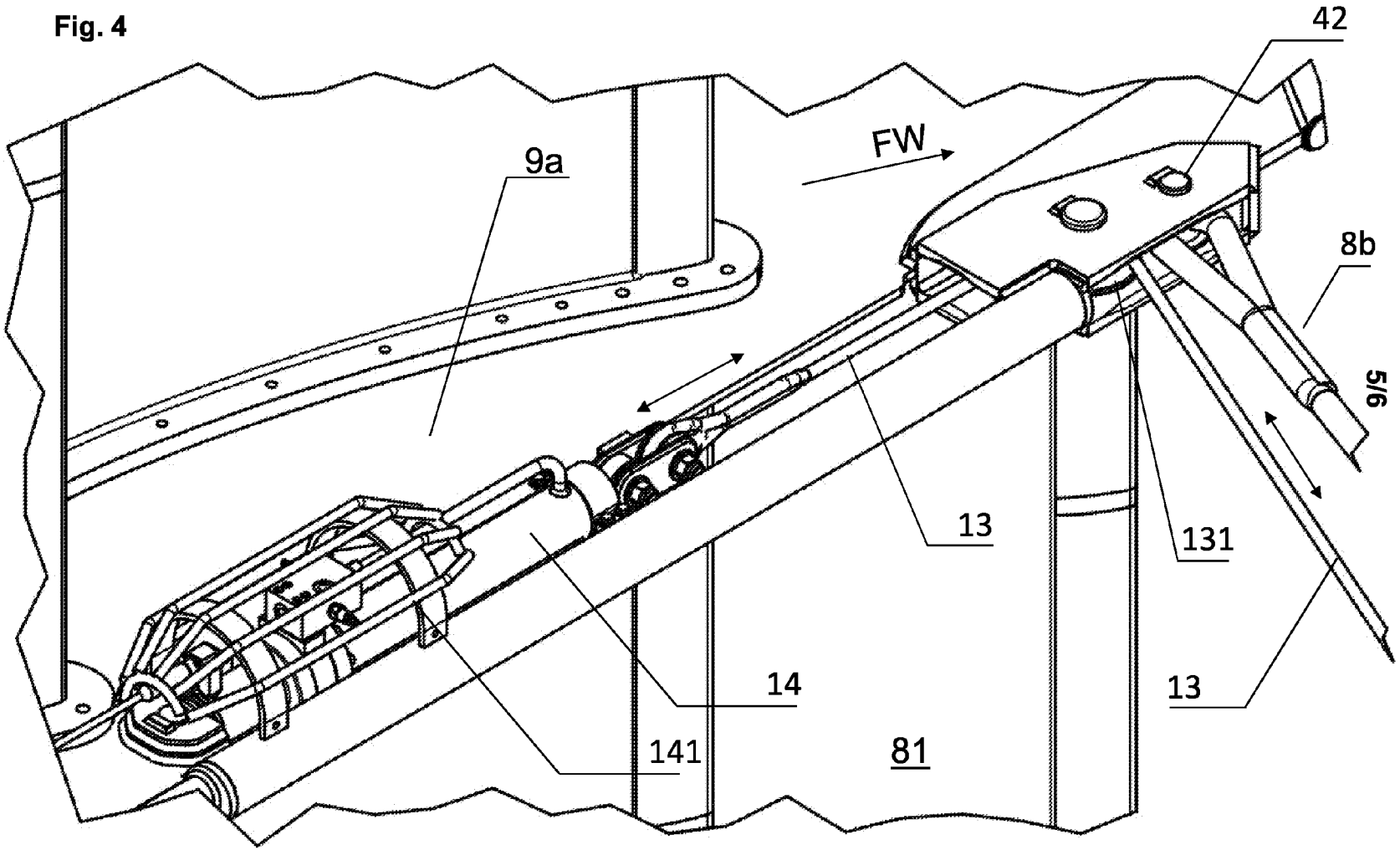

FIG. 4 is a close-up perspective view from FIG. 3*a*, of the fore attachment point, the lug (42) for the middle fore bridle line (8*b*) on the center plate (9*a*) of the paravane, a sheave (131) near the fore lug (42) for guiding the seventh bridle line (13) around to the actuator's (14) working direction. In this way the actuator may reside in a protected position on the center plate and being less vulnerable to flotsam when launched. A small cage (141) is arranged to cover much of the actuator (14).

Figure 5B:
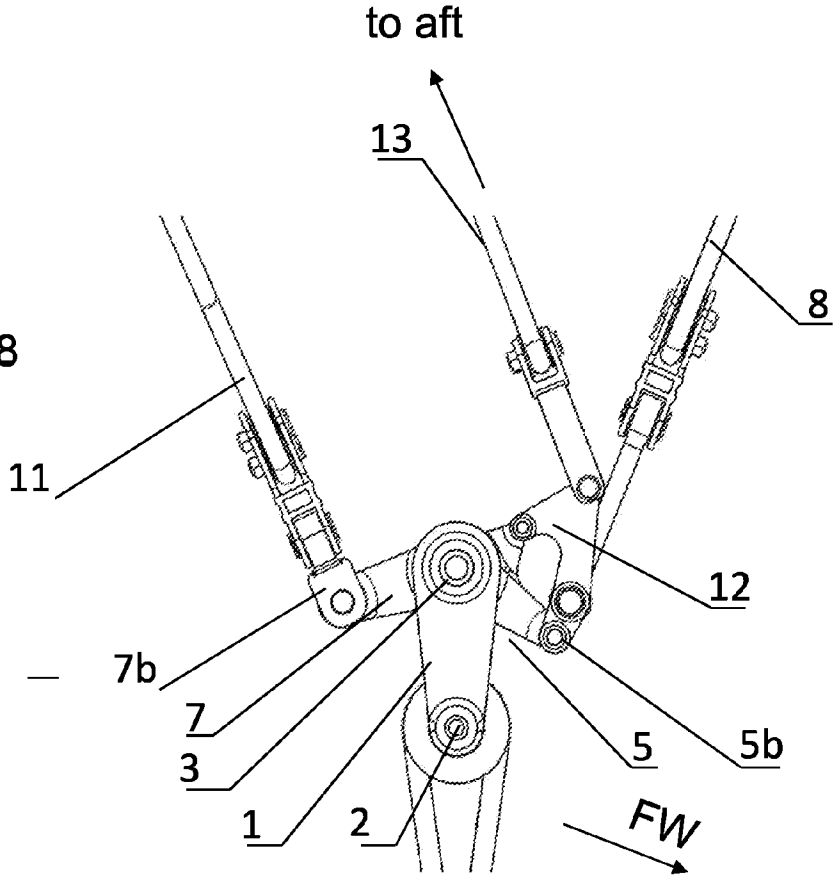
Figure 5A:
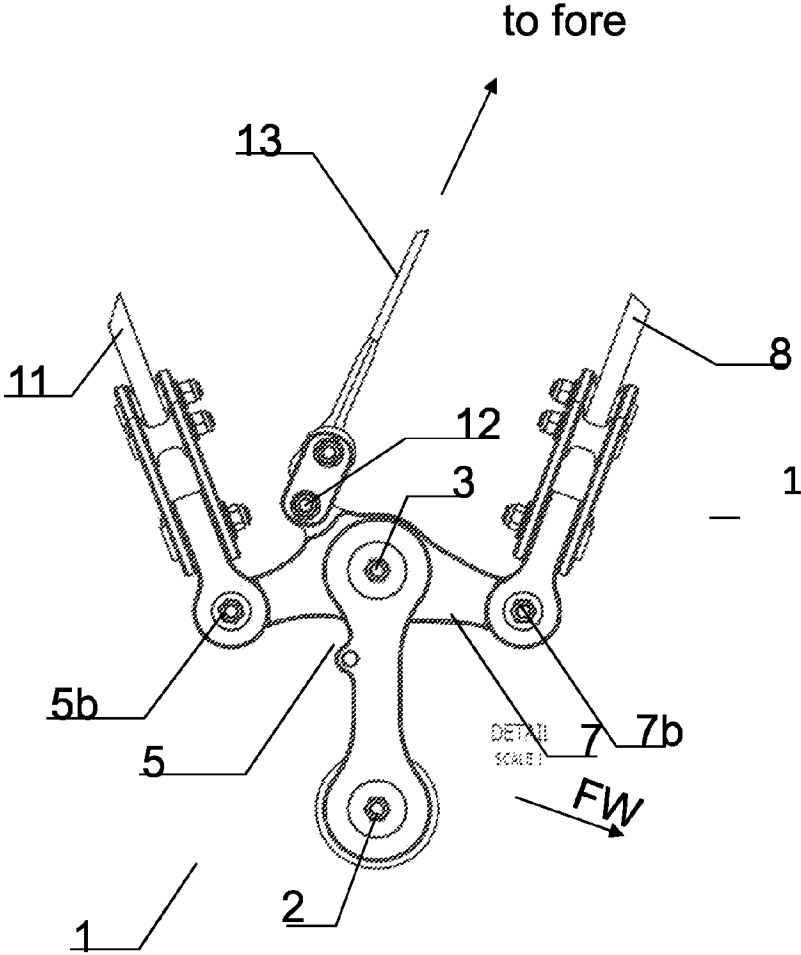

FIG. 5*a* is a detail of FIG. 3*b* showing the above preferred embodiment with the seventh bridle extending from a rearward directed auxiliary moment arm (12) on the bridle block pivot arm to an actuator operating from the fore end of the paravane.

FIG. 5*b* shows a possible alternative embodiment wherein the above principle is reversed; the auxiliary moment arm (12) is at the fore end of the bridle block's running direction through the sea, and the seventh bridle runs back to the aft end of the paravane.

DESCRIPTION OF AN EMBODIMENT OF THE INVENTION

The present invention has a different design for the rotating mechanical element that connects the fore and aft bridle line-ends with each other than what is in the prior art. The mechanical element of the present invention has a fore and aft arm with a pivot axis in the bridle block, and an auxiliary pivot arm to a so-called "seventh bridle" from the paravane which is arranged to set up a force imbalance between the fore and aft bridle line triples. The present invention thus provides a new mechanism for adjustment of the angle of attack of a deflector.

The invention is a bridle block system for a paravane (9) for marine towing, please see the illustration in FIG. 1 and a close-up of the paravane with bridle block in FIGS. 3*a* and 3*b*, which may constitute the port side paravane of the two generally mirror-image paravanes. The marine tow is usually a towed seismic array of streamer cables, for example, six, eight, twelve or a number of seismic streamer cables that run parallel in the sea, please see FIG. 1. The deflector (9) is provided with front and aft bridle line sets (8, 11) comprising double or triple bridle lines (8*a*, 8*b*, 8*c*, 11*a*, 11*b*, 11*c*) to attachment lugs (41, 42, 43, 51, 52, 53) in upper, or middle, and lower portions of the deflector (9). A main block (1) is provided with a first attachment point (2) for a tow line from a seismic vessel and a pivot point (3) for a pivot arm (7, 5).

The main block (1) and pivot arm (5, 7) with its attachment points for the bridle lines is generally called a bridle block. The pivot arm (7, 5) is provided with a usually forward directed first arm (7) with a attachment point (7*b*) near its outer end for the first triple of bridle lines (8). The fore bridle lines (8) preferably extend at right angles to the fore arm (7). The pivot arm (7, 5) has an opposite directed usually rearward directed arm (5) with an attachment point (5*b*) near the outer end of the arm (5) for the aft bridle lines (11). As with the fore bridle lines and the fore arm, the aft bridle lines (11) are generally perpendicular to the arm (5).

In other words, the invention is a bridle block system for a paravane (9) for seismic equipment, comprising a main bridle block (1) with a first connecting point (2) for a towing line from a seismic vessel, and with attachment points (7*b*, 5*b*) for fore and aft triples of bridle lines (8, 11) extending to fore and aft connection points (41, 42, 43, 51, 52, 53) at a side of either ends of said paravane (9), as shown in FIGS. 3*a* and 3*b*. The main block (1) comprises a pivot point (3) for a pivot arm (7, 5). The pivot arm (7, 5) comprises a first, preferably forward directed arm (7) with an attachment point (7*b*) near its outer end for the first triple of bridle lines (8). The pivot arm further has a second, oppositely directed arm (5) with an attachment point (5*b*) near its outer end for the preferably aft, second triple of bridle lines (11). Further, the pivot arm is provided with an auxiliary moment arm (12) connected at the second arm's (5) side relative to the pivot point (3) and connected to the seventh bridle line (13), which could be named a control bridle line (13), which is further connected to an actuator (14) arranged near the first bridle lines' (8) first lugs' (41, 42, 43) end of said paravane (9), which is the fore end in the embodiment shown.

The fore and aft arms (7, 5) will be roughly in balance during towing if you do not exert any turning moment on the pivot arm (7, 5). A moment arm (12) is connected to the rearward directed arm (5) side of the pivot point (3), arranged to exert a moment on the pivot arm (7, 5). The moment arm (12) is in an embodiment connected via a short pivot arm to the arm (5) with an attachment point (5*b*) near the outer end of the arm (5), please see FIG. 5*a*, or may be provided with a short support arm into the pivot point for the pivot arm, please see the inverse embodiment using the opposite arm (7) in FIG. 5*b*. The skilled reader will realize that the two embodiments shown in FIGS. 5*a* and 5*b* are opposite but would work equivalently. Thus "fore" and "aft" may be systematically interchanged in the present invention, and the moment arm (12) may in an alternative embodiment be a part of the forward directed arm (7), please see FIG. 5*b*, which will require the seventh bridle to extend to the aft end of the paravane with correspondingly arranged actuator.

The auxiliary moment arm (12) is connected to a so-called "seventh bridle line" (13) in the form of a wire, line or stay. The reason for this extra bridle line being called the "seventh bridle line" is that there are usually six bridle lines: three fore and three aft bridle lines on a seismic paravane. In the seventh bridle line's (13) opposite end it is connected to a preferably linear actuator (14) arranged near the forward bridle lines' (8) attachment points (42) on the paravane (9), e.g. near a fore deflector wing (91) as shown in FIGS. 3*a* and 3*b*. The actuator (41) may be a hydraulic piston in a cylinder, or a linear electric actuator. Alternatively the actuator (14) may be a winch.

The actuator (14) holds the end of the seventh bridle and tightens or slackens on it. When the actuator (14) tightens the seventh bridle line (13) this leads to a moment on the pivot arm (7, 5) resulting in the fore bridle lines (8*a*, 8*b*, 8*c*) being tightened and the aft bridle lines (11*a*, 11*b*, 11*c*) are slackened, thus creating a force imbalance between the fore and aft bridle lines (8, 11) so as for the paravane's angle of attack changes until the paravane pulls more inwardly to a smaller angle of attack.

In an embodiment of the invention the actuator (14) is a hydraulic cylinder that drives the seventh bridle line (13) which in turn drives the arm (12) which shifts the balance of the pivot arm (5, 7). Alternatively, the actuator may be a winch located at the fore end of center plate (9*b*), arranged to tighten or slacken the bridle line (13).

How the actuator (14) is arranged purely mechanically, and how it is controlled, is a task for the person skilled in the art; a control device on the seismic vessel may monitor the paravane's position and provide a command via a radio transmitter to a receiver (20) on the paravane. The actuator (14) may be provided with a signal receiver (20), please see FIG. 3*a*, in order to be controlled from the seismic vessel and it is a task for the person skilled in the art to design and install such control devices. The control device controls the hydraulic pressure to the actuator (14) to the desired extension so as for the desired angle of attack relative to the course line to be set.

Although the bridle block here is explained by the "seventh bridle line" connected between an arm connected to the rearward directed arm portion of a pivot arm and an actuator installed in the forward part of the paravane, the whole thing would work if you turned the bridle block according to the invention so that the bridle-line was connected between an arm connected to the forward arm of the pivot arm and an actuator on the rear part of the paravane. In the above description the auxiliary moment arm is connected to the seventh bridle line, which is further connected to an actuator arranged near the opposite, first bridle lines' attachment points to the paravane. Arranging the actuator at the bridle block instead of at the paravane would be possible, but less advantageous embodiment of the present invention, however requiring a power supply from the vessel or the paravane to the bridle block. The bridle block system according to the invention may be modified to a paravane using two fore and two aft bridle lines, even though the term "seventh" may seem confusing. This may require a repositioning of the "seventh bridle" of the invention to extend in the middle plane of the paravane as in the present invention, or to extend to an actuator in the upper or lower horizontal plate, or using two "seventh bridles" to both the upper and lower plates.

It should be noted that any combination of the claimed features is considered to be combined.

The invention claimed is:

1. A bridle block system for a paravane for seismic equipment, comprising the following features:

a main bridle block with a connecting point for a towing line from a seismic vessel, and with attachment points for first and second triples of bridle lines extending to first and second lugs at either ends of said paravane;

said main block comprising a pivot point for a pivot arm, said pivot arm comprising a first arm with an attachment point near its outer end for said first triple of bridle lines, and a second, oppositely directed arm with an attachment point near its outer end for said second triple of bridle lines, an auxiliary moment arm connected at said second arm's side relative to said pivot point and connected to a seventh bridle line, which is further connected to an actuator arranged near said first bridle lines' first lugs' end of said paravane.

2. The bridle block system according to claim 1, said first arm directed in a direction perpendicular to said first triple of bridle lines.

3. The bridle block system according to claim 2, said second arm directed in a direction perpendicular to said second triple of bridle lines.

4. The bridle block system according to claim 2, wherein said actuator for said seventh bridle line is arranged at a center plate.

5. The bridle block system according to claim 2, wherein said actuator is provided with a signal receiver arranged to receive a signal from a corresponding signal transmitter on the seismic vessel and control said actuator.

6. The bridle block system according to claim 2, wherein said actuator is linear.

7. The bridle block system according to claim 1, said second arm directed in a direction perpendicular to said second triple of bridle lines.

8. The bridle block system according to claim 7, wherein said actuator for said seventh bridle line is arranged at a center plate.

9. The bridle block system according to claim 7, wherein said actuator is provided with a signal receiver arranged to receive a signal from a corresponding signal transmitter on the seismic vessel and control said actuator.

10. The bridle block system according to claim 7, wherein said actuator is linear.

11. The bridle block system according to claim 1, wherein said actuator for said seventh bridle line is arranged at a center plate.

12. The bridle block system according to claim 11, wherein said seventh bridle line is laid over a sheave near said first lugs on said center plate, and said actuator is a linear actuator arranged in the paravane's longitudinal direction.

13. The bridle block system according to claim 11, wherein said actuator is provided with a signal receiver arranged to receive a signal from a corresponding signal transmitter on the seismic vessel and control said actuator.

14. The bridle block system according to claim 1, wherein said actuator is provided with a signal receiver arranged to receive a signal from a corresponding signal transmitter on the seismic vessel and control said actuator.

15. The bridle block system according to claim 1, wherein said actuator is linear.

16. The bridle block system according to claim 15, said actuator comprising a hydraulic cylinder.

17. The bridle block system according to claim 1, wherein said actuator for said seventh bridle line is arranged near said first lugs for said first triple of bridle lines said paravane.

18. The bridle block system according to claim 1, said seventh bridle line being a wire, rope or a stay.

19. The bridle block system according to claim 1, said first arm directed in a generally forward direction of said paravane, said second arm and said auxiliary moment arm directed in a generally aft direction of said paravane.

20. The bridle block system according to claim 1, said first arm directed in a generally aft direction of said paravane, said second arm and said auxiliary moment arm directed in a generally forward direction of said paravane.

* * * * *